United States Patent [19]

Borden

[11] Patent Number: 4,646,378

[45] Date of Patent: Mar. 3, 1987

[54] TOOL FOR FIREMAN

[76] Inventor: David M. Borden, Blossom Hill, Wawa, Pa. 19063

[21] Appl. No.: 885,745

[22] Filed: Jul. 21, 1986

Related U.S. Application Data

[63] Continuation of Ser. No. 682,865, Dec. 18, 1984, abandoned.

[51] Int. Cl.[4] ..... B25B 13/10; B25F 1/00; B66F 15/00

[52] U.S. Cl. ..... 7/140; 7/138; 7/166

[58] Field of Search ..... 7/138, 140, 166, 170

[56] References Cited

U.S. PATENT DOCUMENTS

| | | | |
|---|---|---|---|
| 372,444 | 11/1887 | Allen | 7/166 |
| 2,195,667 | 4/1940 | Baker | 7/166 |
| 3,949,439 | 4/1976 | Ardis | 7/138 |

*Primary Examiner*—Frederick R. Schmidt
*Assistant Examiner*—Maurina Rachuba
*Attorney, Agent, or Firm*—James A. Wong

[57] ABSTRACT

A neat and simple combination tool comprising first and second tool members with hinge structure pivotally securing the first and second members together so that they may be selectively pivoted between opened and closed positions of use wherein the first tool member includes a pair of spaced-apart generally parallel extending side walls forming a sheath portion between which the second tool member may be folded or enclosed in closed position thereof, the first tool member also including a first tool portion and a first bridge portion at one end thereof and a second bridge portion adjacent the other end thereof but intermediate these ends, the first and second bridge also extending between and integrally connecting side walls, the second tool member including second and third tool portions at opposite ends thereof and an intermediate region adjacent the second tool portion with this intermediate region being disposed between the side walls and hingedly assembled adjacent the other end of the first tool member, wherein in the folded or closed position of the combination tool, the second tool member is disposed between the side walls and resting on the bridge portions and the second and third tool portions extend beyond the opposite ends of the first tool member and the first tool portion is disposed in exposed condition so that all three tool portions are available for use in both the opened and folded or closed conditions of the tool members.

9 Claims, 8 Drawing Figures

TOOL FOR FIREMAN

This is a continuation of co-pending application Ser. No. 682,865 filed on Dec. 18, 1984 now abandoned.

BACKGROUND OF THE INVENTION

The invention disclosed and claimed herein relates to a new and improved tool for firemen and, in particular, to a tool for use in the coupling and uncoupling of fire hoses and related operations in connection with fire fighting. Experience in fire fighting activities has shown that a useful tool must be versatile as well as being compact so that it will not be limited to only a few operations, but would instead be adaptable to other operations besides its use in conjunction with fire hoses. A useful tool will thus be operative in conjunction with different types of hose couplings as well as being applicable to turning off various forms of gas valves and to performing other tasks.

OBJECTS OF THE INVENTION

Consistent with the background of the invention set forth above, applicant has conceived the present invention to provide a new and improved tool for firemen's use in various tasks which may arise from beginning to end of fire fighting activities.

Accordingly, it is an object of this invention to provide a new and improved tool suitable for use in connecting and disconnecting fire hose couplings.

It is another object of this invention to provide a new and improved tool which can be used to turn off gas valves having various forms of nut-like heads on which a tool may be applied for rotation thereof.

It is still another object of this invention to provide a new and improved tool which may provide a spanner function, if needed, against lugs on a hose coupling collar.

It is yet another object of this invention to provide a new and improved tool which includes structure for carrying out a prying operation.

It is a further object of this invention to provide a new and improved tool which includes structure for carrying out a picking operation on certain types of hose couplings.

Another object of this invention is to provide a new and improved tool which, while versatile, is also compact and thus convenient to carry and easy to use.

BRIEF DESCRIPTION OF THE DRAWINGS

The objects enumerated above, as well as various advantages or benefits of the present invention, will be readily appreciated by the reader upon referring to the appended drawings in which.

DETAILED DESCRIPTION OF THE PREFERRED EMBODIMENT OF THE INVENTION

Figure 1:
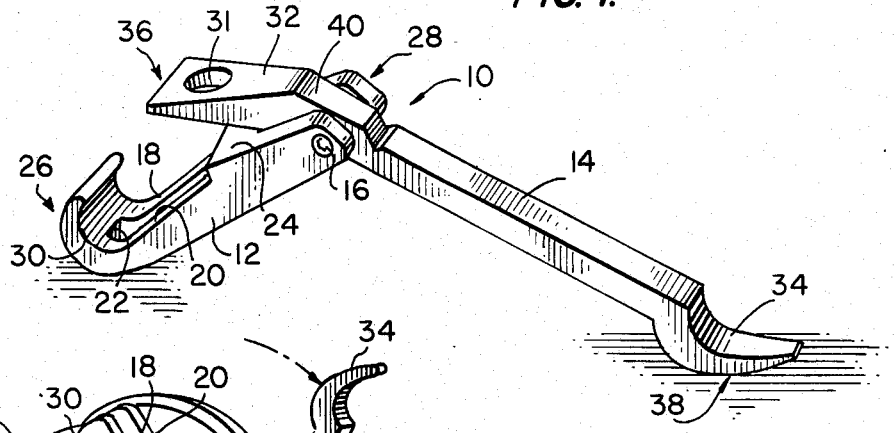
FIG. 1 is a side view in perspective of the disclosed invention in opened or unfolded condition thereof.
Figure 8:
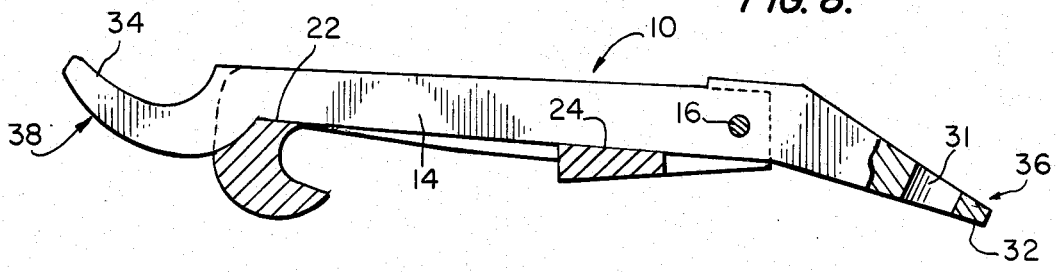
FIG. 8 is a side elevational view of the tool in folded condition thereof and with a portion thereof broken away or removed to reveal details otherwise obscured.

Referring now to the drawings in detail, the reader will readily appreciate that the disclosed invention is embodied in a neat and simple combination tool 10 comprising first and second tool members 12 and 14, respectively, with hinge means 16 pivotally securing first and second members 12, 14 together so that same may be selectively pivoted between opened and closed positions of use. As may be readily seen in FIGS. 1–3, first tool member 12 includes a pair of spaced-apart generally parallel extending side walls 18, 20 forming a sheath portion between which second tool member 14 may be folded or enclosed in closed position or condition thereof. First tool member 12 also includes a first tool portion 30 and a first bridge portion 22 at one end 26 thereof and a second bridge portion 24 adjacent the other end 28 thereof but intermediate these ends 26 and 28. First and second bridge portions 22 and 24 are also shown to extend between and integrally connect side walls 18 and 20. Second tool member 14, as disclosed, includes second and third tool portions 32 and 34 at opposite ends 36 and 38, respectively, thereof and an intermediate region 40 adjacent the second tool portion 32. This intermediate region 40 is disposed between side walls 18 and 20 and hingedly assembled adjacent the other end 28 of first tool member 12, wherein in the folded or closed position or condition of combination tool 10, second tool member 14 extends between side walls 18 and 20 and rests on bridge portions 22 and 24 as seen in FIG. 8 while second and third tool portions 32 and 34 extend beyond opposite ends 26 and 28 of first tool member 12 and first tool portion 30 extends in exposed condition so that all three tool portions 30, 32, and 34 are available for use in both the opened and folded or closed conditions of tool members 12 and 14.

Figure 3:
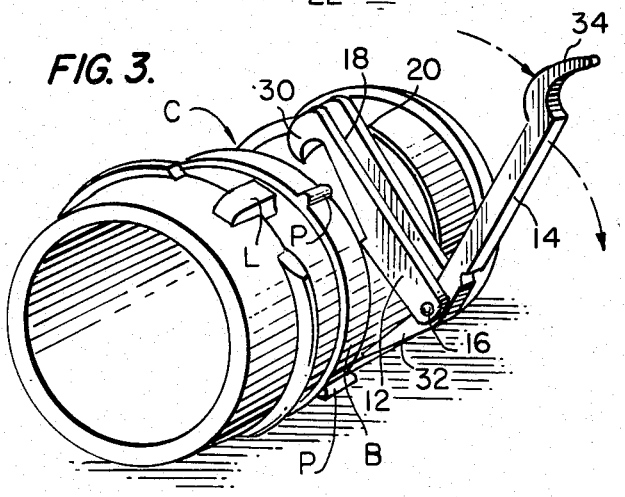
FIG. 3 shows the tool opened as in FIG. 1, but turned up-side-down and applied in a spanner wrench operation.

Upon closer inspection, the reader will readily observe that a hook structure is formed on first tool portion 30 at the one end 26 of first tool member 12. This hook structure extends away from side walls 18 and 20. Second and third tool portions 32 and 34 at opposite ends 36 and 38 of second tool member 14 are in the form of a wedge prying structure and an arcuate pick structure, respectively. It may also be readily observed that first and second tool members 12 and 14 may be pivoted to open condition whereby hook structure 30 or first tool portion may be applied to a lug L of a typical collar of a coupling C or to a pin-type lug P on the periphery of a collar B of a different form to operate as a spanner wrench with one edge of second tool portion 32 of second tool member 14. With hook structure 30 and tool portion 32 simultaneously applied to such a hose coupling wherein tool portion 32 functioning as a fulcrum and second tool member 14 cranked in the direction of the arrows, as illustrated in FIG. 3, the disclosed tool 10 is used as a spanner wrench.

Figure 2:
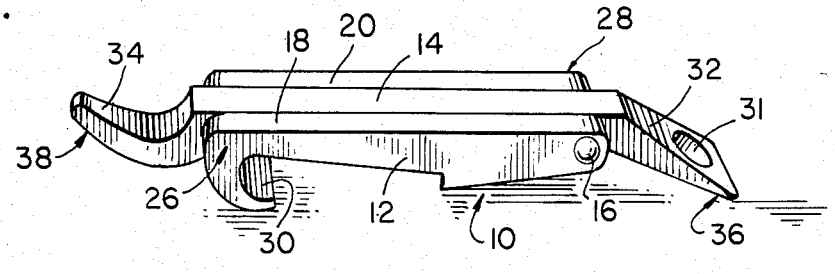
FIG. 2 is a side view in perspective of the disclosed invention in closed or folded condition thereof.
Figure 4:
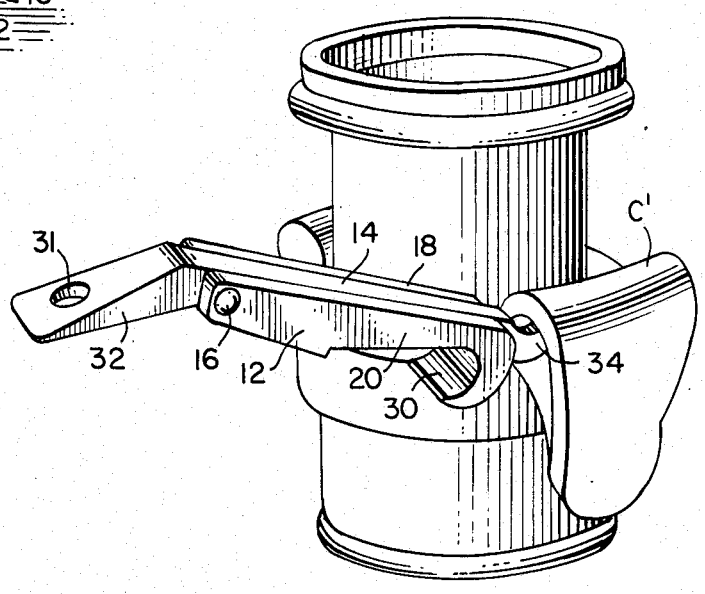
FIG. 4 shows the tool as in FIG. 2, but turned 180% therefrom and applied in a picking operation.
Figure 5:
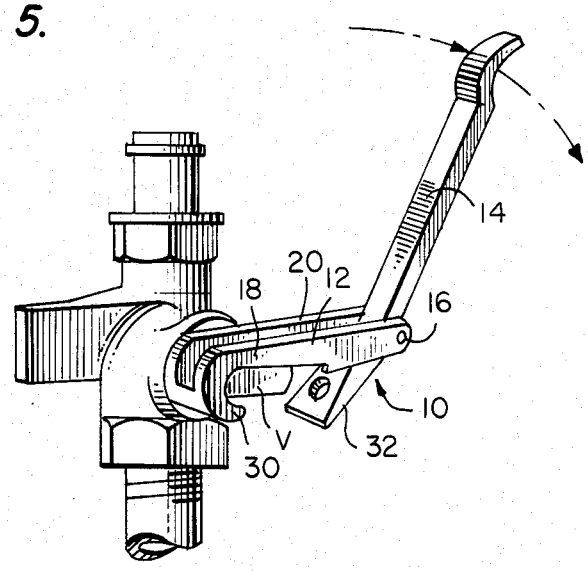
FIGS. 5–7 show the present invention applied to the nut or head portion of various gas valves to effect shutting thereof, for example.
Figure 6:
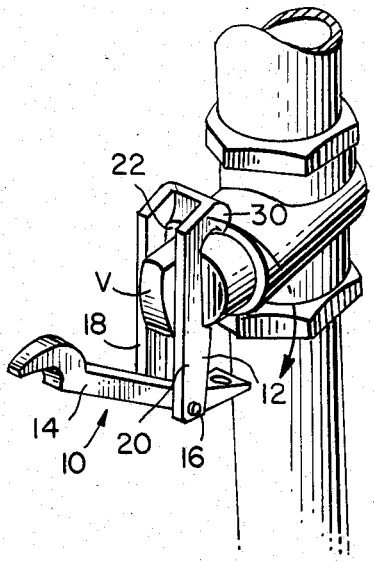
Figure 7:
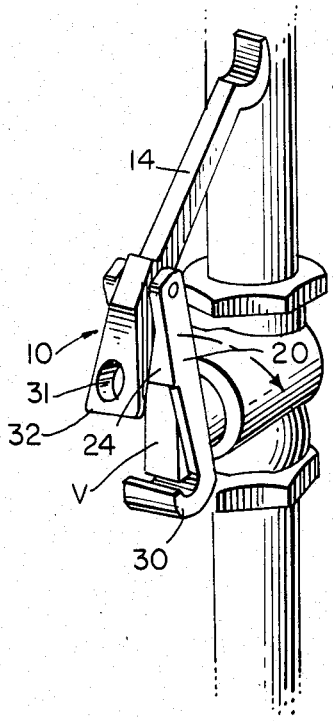

Other uses of combination tool 10 are suggested in FIGS. 5–7, wherein a nut or bolt head V on certain known gas meter valves may be admitted between side walls 18 and 20 of first tool member 12 which may then be used as an ordinary wrench for effecting rotary motion or within the expanse of hook 30. It is also noted that in the closed or folded condition of tool 10, the upper or outer edge of second tool member 14 blends in or is generally within the confines of the outline of the upper or outer edges of side walls 18 and 20 of first tool member 12 to thereby form a handle without obtrusive portions as illustrated in FIGS. 2, 4, and 8 so that tool 10 may be gripped and used with comfort. Insofar as the assembly of the disclosed parts of tool 10 is concerned, hinge means 16 is understood to comprise a pivot member in the form of gudgeon, trunnion, pin elements or the like. The use of first tool portion 30 at the first end 26 of first tool member 12 which extends in a direction away from side walls 18 and 20 in the form of a hook to grip a lug portion L of conventional hose coupling structure and second tool portion 32 which in the opened condition of tool 10 extends beyond first tool member 12 in generally the same direction as first tool portion 30 and in spaced-apart relationship therefrom to operate as a fulcrum against an area of a hose coupling C away from the lug L that would be gripped, and the third tool portion 34 which extends in a direction away from that of first and second tool portions 30 and 32 to provide a cranking handle in use of tool 10 as a spanner wrench is shown in FIG. 3.

PREFERRED EMBODIMENT

While there are numerous optional embodiments of the disclosed tool assembly 10, applicant has constructed a preferred embodiment comprising three basic parts, namely, first and second tool members 12, 14 made out of cadmium plated ductile iron and hinge pin 16. Instead of ductile iron, tool members 12, 14 may, for example, be made of malleable steel. As mentioned above, tool portion 30 of first tool member 12 is formed with a hook structure for gripping engagement with a lug L or pin-type lug P to connect or disconnect a hose of the type commonly employed in fire fighting operations. Tool 10, as shown in FIG. 4 in folded or closed condition, is used with arcuate pick 34 inserted under the inside of a hose coupling of the type having a spring-loaded, hinge clip C′ to pry the latter open by a downward force applied on second tool portion 32 serving as a handle.

Another alternative use of the disclosed tool 10 in contrast to its use as a spanner wrench, such as in FIG. 3, is shown in FIG. 5 with the hook structure 30 disposed against valve head V of a gas meter for rotation by force applied in the direction of the arrows to tool member 14 which is used as a handle. Other alternative uses of tool 10 are shown in FIGS. 6 and 7. In FIG. 6, a valve head V is admitted between side walls 18, 20 from the hook side of tool member 12 with rotation being applied to tool member 14 in the direction of the arrow to obtain rotation about the axis of valve head V. FIG. 7 shows a further alternative use of tool 10 where valve head V is admitted between side walls 18, 20 from behind hook 30 of tool member 12 after which rotation is achieved generally similar to the procedure illustrated in FIG. 6.

Besides using the arcuate pick 34 of tool member 14 in the operation described above, tool portion 32, which has a chisel or wedge structure at the opposite end of tool member 14, may be used in lifting, prying, scraping, and numerous other operations. Aperture 31 is provided in the surface of tool portion 32 for any number of useful purposes besides for reception of a nail, hook, or the like for storage of tool 10.

It will be obvious to those skilled in the art that various changes may be made to the disclosed structure without departing from the scope of the invention which is not to be considered as being limited to what is shown in the drawings and described in the specification.

What is claimed is:

1. A neat and simple combination tool comprising first and second one-piece tool members with a single hinge means pivotally securing said first and second one-piece members together so that said first and second one-piece members may be selectively pivoted between opened and closed positions of use wherein said first one-piece tool member includes a pair of spaced-apart generally parallel extending side walls forming a sheath portion between which said second one-piece tool member may be folded or enclosed in closed position thereof, said first one-piece tool member also including a first tool portion and a first bridge portion at one end thereof and a second bridge portion adjacent the other end thereof but intermediate said ends, said first and second bridge portions also extending between and integrally connecting said side walls, said second one-piece tool member including second and third tool portions at opposite ends thereof and an intermediate region adjacent the second one-piece tool portion with said intermediate region being disposed between said side walls and hingedly assembled adjacent said other end of said first one-piece tool member, wherein in the folded or closed position of said combination tool, said second one-piece tool member is disposed between said side walls and resting on said bridge portions and said second and third tool portions extend beyond said opposite ends of said first one-piece tool member and said first tool portion is disposed in exposed condition so that all three tool portions are available for use in both the opened and folded or closed conditions of said one-piece tool members

2. A neat and simple combination tool comprising first and second one-piece tool members with a single hinge means pivotally securing said first and second one-piece members together so that said first and second one-piece members may be selectively pivoted between opened and closed positions of use wherein said first one-piece tool member includes a pair of spaced-apart generally parallel extending side walls forming a sheath portion between which said second one-piece tool member may be folded or enclosed in closed position thereof, said first one-piece tool member also including a first tool portion and a first bridge portion at one end thereof and a second bridge portion adjacent the other end thereof but intermediate said ends, said first and second bridge portions also extending between and integrally connecting said side walls, said second one-piece tool memmber including second and third tool portions at opposite ends thereof and an intermediate region adjacent the second tool portion with said intermediate region being disposed between said side walls and hingedly assembled adjacent said other end of said first one-piece tool member, wherein in the folded or closed position of said combination tool, said second one-piece tool member is disposed between said side walls and resting on said bridge portions and said second and third tool portions extend beyond said opposite ends of said first one-piece tool member and said first tool portion is disposed in exposed condition so that all three tool portions are available for use in both the opened and folded or closed conditions of said one-piece tool members.

3. The tool as defined in claim 2, wherein said first tool portion at said one end of said first tool member includes a hook structure extending away from said side walls, said second and third tool portions at opposite ends of said second tool member include a wedge prying structure and an arcuate pick structure, respectively.

4. The tool as defined in claim 3, wherein said first and second tool members may be pivoted to open condition whereby said hook structure may be applied to a lug on the periphery of a typical hose coupling as a spanner wrench and one edge of said second tool portion on said second tool member may be simultaneously applied to such a hose coupling as a fulcrum.

5. The tool as defined in claim 4, wherein a nut or bolt head on certain known gas meter valves may be admitted between said side walls of said first tool member which may then be used as a wrench for effecting rotary motion.

6. The tool as defined in claim 5, wherein in the closed or folded condition of said tool, the upper or outer edge of said second tool member blends in or is generally within the confines of the outline of the upper or outer edges of said side walls of said first tool member so as to form a handle without obtrusive portions whereby said tool may be gripped and used with comfort.

7. The tool as defined in claim 2, wherein said hinge means comprises a pivot pin.

8. The tool as defined in claim 2, wherein said first tool portion at said first end of said first tool member extends in a direction away from said side walls in the form of a hook adaptable to gripping a lug portion of conventional hose coupling structure and said second tool portion in the opened condition of said tool extends beyond said first tool member in generally the same direction as said first tool portion and in spaced-apart relationship therefrom to operate as a fulcrum against an area of a hose coupling away from the lug that would be gripped, and the third tool portion extends in a direction away from that of said first and second tool portions to provide a cranking handle in use of said tool as a spanner wrench.

9. A neat and simple combination tool comprising first and second one-piece tool members with a single hinge means pivotally securing said first and second one-piece members together so that said first and second one-piece members may be selectively pivoted between opened and closed positions of use wherein said first one-piece tool member includes a pair of spaced-apart generally parallel extending side walls forming a space in which a valve head may be inserted for rotation, as well as a sheath portion between which said second one-piece tool member may be folded or enclosed in closed position thereof, said first one-piece tool member also including a first tool portion and a first bridge portion at one end thereof and a second bridge portion adjacent the other end thereof but intermediate said ends, said first and second bridge portions also extending between and integrally connecting said side walls, said second one-piece tool member including second and third tool portions at opposite ends thereof and an intermediate region adjacent the second tool portion with said intermediate region being disposed between said side walls and hingedly assembled adjacent said other end of said first one-piece tool member, wherein in the folded or closed position of said combination tool, said second one-piece tool member is disposed between said side walls and resting on said bridge portions and said second and third tool portions extend beyond said opposite ends of said first one-piece tool member and said first tool portion is disposed in exposed condition so that all three tool portions are available for use in both the opened and folded or closed conditions of said one-piece tool members.

* * * * *